US010436161B2

(12) United States Patent
Kim et al.

(10) Patent No.: US 10,436,161 B2
(45) Date of Patent: Oct. 8, 2019

(54) STRAINER AND FUEL PUMP MODULE HAVING THE SAME

(71) Applicant: COAVIS, Yeongi-gun (KR)

(72) Inventors: Jeong Sik Kim, Daejeon (KR); Woo Keun Lee, Daejeon (KR); Du Hyun Kim, Miryang-si (KR); Eun Ju Lee, Sejong-si (KR)

(73) Assignee: COAVIS, Yeongi-Gun (KR)

( * ) Notice: Subject to any disclaimer, the term of this patent is extended or adjusted under 35 U.S.C. 154(b) by 0 days.

(21) Appl. No.: 16/171,829

(22) Filed: Oct. 26, 2018

(65) Prior Publication Data

US 2019/0063383 A1 Feb. 28, 2019

Related U.S. Application Data

(62) Division of application No. 14/283,553, filed on May 21, 2014, now Pat. No. 10,145,341.

(30) Foreign Application Priority Data

May 23, 2013 (KR) ..... 10-2013-0058095

(51) Int. Cl.
*F02M 37/14* (2006.01)
*F02M 37/50* (2019.01)

(52) U.S. Cl.
CPC ..... *F02M 37/14* (2013.01); *F02M 37/50* (2019.01); *Y10T 137/794* (2015.04)

(58) Field of Classification Search
None
See application file for complete search history.

(56) References Cited

U.S. PATENT DOCUMENTS

| | | | | |
|---|---|---|---|---|
| 796,910 | A | 8/1905 | Hernan | |
| 1,058,133 | A | 4/1913 | Yourtree | |
| 1,394,011 | A | 10/1921 | Hills | |
| 1,568,796 | A | 1/1926 | Breer | |
| 1,677,118 | A | 7/1928 | Ford | |
| 1,773,134 | A | 8/1930 | Fisher | |
| 2,253,509 | A | 8/1941 | Dort | |
| 2,424,211 | A * | 7/1947 | Webb ..... | B01D 35/0273 210/460 |

(Continued)

FOREIGN PATENT DOCUMENTS

KR 2019890010861 7/1989

*Primary Examiner* — Robert J Popovics
(74) *Attorney, Agent, or Firm* — Cantor Colburn LLP

(57) ABSTRACT

Provided is a strainer including: a filter paper filtering fuel and having a space part disposed therein; an inner rib disposed inside the filter paper; protruding parts protruding up and down from the inner rib to be disposed inside the filter paper; and a communicating pipe combined with the filter paper to communicate with the space part. The filter paper and the inner rib are partially folded up longitudinally. The folded portion is formed in a rounded form, and the upper and lower portions of the filter paper are formed not to contact each other at the folded portion. Widths of the protruding parts are each formed differently and distances between the protruding parts are each formed differently. The width and the distance are more narrowly formed at the portion at which the filter paper is folded than at the portion at which the filter paper is not folded.

2 Claims, 8 Drawing Sheets

(56) References Cited

U.S. PATENT DOCUMENTS 2,770,362 A * 11/1956 Paquin ..... B01D 35/027 210/172.4
2,788,125 A * 4/1957 Webb ..... B01D 35/0273 210/172.4
3,023,905 A 3/1962 McDougal et al.
3,108,065 A * 10/1963 McMichael ..... B01D 35/0273 210/172.3
3,294,025 A 12/1966 Niemeyer et al.
3,314,544 A 4/1967 Rosaen
3,826,372 A * 7/1974 Bell ..... B01D 35/0273 210/172.4
3,875,059 A * 4/1975 Maschino ..... B01D 29/114 210/172.3
3,900,397 A * 8/1975 Bell ..... B01D 35/0273 210/128
4,303,513 A * 12/1981 Lundquist ..... B01D 35/027 210/132
4,304,664 A * 12/1981 McAlindon ..... B01D 17/10 210/172.3
4,402,827 A * 9/1983 Joseph ..... B01D 35/0273 210/167.08
4,546,750 A * 10/1985 Brunell ..... B60K 15/077 123/514
4,617,121 A * 10/1986 Yokoyama ..... B01D 29/15 210/416.4
4,851,118 A 7/1989 Kurihara
4,853,123 A * 8/1989 Hayes ..... B01D 29/111 210/316
4,966,522 A 10/1990 Koyama
5,049,267 A * 9/1991 Sasaki ..... B01D 29/114 210/172.3
5,049,271 A * 9/1991 Cain ..... B01D 29/15 210/250
5,055,187 A * 10/1991 Ito ..... B01D 29/15 210/172.4
5,111,844 A * 5/1992 Emmert ..... F02M 37/106 123/514
5,120,434 A 6/1992 Yoshida
5,146,901 A * 9/1992 Jones ..... F02M 25/0854 123/509
5,312,545 A 5/1994 Starin et al.
5,395,520 A * 3/1995 Ito ..... B01D 29/15 210/172.4
5,398,659 A * 3/1995 Zimmerman ..... F02M 37/106 123/514
5,409,608 A * 4/1995 Yoshida ..... B01D 29/15 210/315
5,415,146 A * 5/1995 Tuckey ..... B01D 35/0273 123/509
5,511,957 A * 4/1996 Tuckey ..... B01D 35/0273 417/313
5,547,568 A 8/1996 Sasaki
5,582,729 A * 12/1996 Shioda ..... B01D 35/0273 210/461
5,584,988 A * 12/1996 Hashimoto ..... B01D 29/15 210/136
5,607,578 A 3/1997 Ohkouchi et al.
5,639,367 A * 6/1997 Ohzeki ..... B01D 35/0273 210/315
5,647,329 A 7/1997 Bucci et al.
5,665,229 A * 9/1997 Fitzpatrick ..... B01D 35/027 210/232
5,776,341 A 7/1998 Barnard et al.
5,787,865 A * 8/1998 Harris ..... B01D 35/0273 123/516
5,795,468 A 8/1998 Reising et al.
5,809,975 A * 9/1998 Tuckey ..... B01D 35/0273 123/509
6,220,454 B1 * 4/2001 Chilton ..... B01D 29/15 210/483
6,382,190 B1 * 5/2002 Tanabe ..... B01D 29/071 123/509
6,451,205 B1 * 9/2002 McGaw, Jr. ..... B29C 65/08 156/73.3
6,464,872 B1 * 10/2002 Honda ..... B01D 29/111 210/416.4
6,471,072 B1 * 10/2002 Rickle ..... F02M 37/50 210/486
6,575,309 B1 * 6/2003 Chiga ..... B01D 29/05 210/435
6,638,423 B2 * 10/2003 Dockery ..... B01D 35/0273 210/132
6,739,354 B2 * 5/2004 Oku ..... B01D 35/0273 137/565.22
6,923,164 B1 * 8/2005 Mitsudou ..... F02M 37/103 123/509
7,134,568 B2 11/2006 Moriyama et al.
7,429,322 B2 9/2008 Fujita et al.
7,478,729 B2 * 1/2009 Sato ..... F02M 37/50 210/491
7,857,143 B2 * 12/2010 Oku ..... F02M 37/106 210/416.4
7,901,572 B2 3/2011 Sato
7,964,096 B2 6/2011 Kimisawa et al.
8,029,667 B2 10/2011 Santinon
8,038,877 B2 10/2011 Stausberg et al.
8,137,546 B2 3/2012 Ogose
8,173,013 B2 5/2012 Sato et al.
8,372,278 B1 2/2013 Nguyen et al.
8,460,542 B2 * 6/2013 Oku ..... B01D 29/114 210/172.4
8,490,682 B2 * 7/2013 Graber ..... B01D 29/114 165/104.19
8,496,812 B2 * 7/2013 Beer ..... F01M 11/0004 210/167.03
8,715,497 B2 5/2014 Schnipke et al.
9,132,366 B2 * 9/2015 Ueki ..... B01D 35/0273
9,441,586 B2 9/2016 Akagi et al.
9,470,193 B2 10/2016 Ries et al.
9,486,725 B2 11/2016 Ries et al.
9,567,955 B2 * 2/2017 Akagi ..... F02M 37/103
9,573,085 B2 * 2/2017 Beer ..... F01M 11/0004
9,816,470 B2 11/2017 Nishio
10,024,283 B2 7/2018 Ishitoya et al.
10,145,341 B2 * 12/2018 Kim ..... F02M 37/14
10,190,554 B2 * 1/2019 Ishimitsu ..... F02M 37/0011
10,267,276 B2 * 4/2019 Nishio ..... F02M 37/10
2003/0042185 A1 * 3/2003 Dockery ..... B01D 35/0273 210/132
2003/0080046 A1 * 5/2003 Ito ..... B01D 29/111 210/416.4
2003/0111060 A1 6/2003 Ito et al.
2003/0132156 A1 * 7/2003 Rickle ..... B01D 35/0273 210/416.4
2004/0007520 A1 1/2004 Rosendahl et al.
2004/0020839 A1 2/2004 Kato et al.
2004/0054884 A1 3/2004 Roth et al.
2004/0129626 A1 7/2004 Fischer et al.
2004/0140257 A1 7/2004 Dockery et al.
2004/0144705 A1 7/2004 Yamada et al.
2004/0159602 A1 8/2004 Brower et al.
2004/0222143 A1 11/2004 Kojima et al.
2004/0251194 A1 12/2004 Brzozowski et al.
2005/0006300 A1 1/2005 Sato et al.
2005/0023201 A1 2/2005 Sato
2005/0029173 A1 2/2005 Kimisawa et al.
2005/0029180 A1 2/2005 Kimisawa et al.
2005/0087178 A1 4/2005 Milton
2005/0087485 A1 * 4/2005 Takahashi ..... B01D 35/0273 210/232
2005/0236321 A1 * 10/2005 Usui ..... B01D 35/0273 210/416.4
2005/0274361 A1 12/2005 Ikeya
2006/0138035 A1 * 6/2006 Izutani ..... F02M 37/103 210/172.3
2006/0254974 A1 11/2006 Khalil et al.
2006/0266693 A1 11/2006 Yoshida et al.
2006/0266701 A1 11/2006 Dickerson et al.
2007/0095733 A1 5/2007 Pizzo et al.
2007/0181102 A1 8/2007 Hazama

(56) References Cited

U.S. PATENT DOCUMENTS

2007/0199884 A1 8/2007 Nakagawa et al.
2007/0215122 A1 9/2007 Nakagawa et al.
2007/0246420 A1 10/2007 Sato
2008/0185331 A1 8/2008 Sato et al.
2008/0245724 A1 10/2008 Oku et al.
2008/0290013 A1 11/2008 Stausberg et al.
2009/0025690 A1* 1/2009 Yamada ..... F02M 37/106 123/509
2009/0039011 A1 2/2009 Sato et al.
2009/0050551 A1 2/2009 Kimisawa et al.
2009/0120858 A1 5/2009 Kojima et al.
2009/0139922 A1 6/2009 Poskie et al.
2009/0301954 A1 12/2009 Beer et al.
2009/0321347 A1 12/2009 Ogose
2010/0038296 A1 2/2010 Beer et al.
2010/0072120 A1 3/2010 Sato
2010/0206793 A1 8/2010 Oku et al.
2010/0206802 A1 8/2010 Sato et al.
2010/0294464 A1 11/2010 Graber et al.
2010/0307615 A1* 12/2010 Takahashi ..... F02M 37/106 137/544
2011/0036763 A1 2/2011 Santinon
2011/0132825 A1 6/2011 Nishio
2011/0139278 A1 6/2011 Kawajiri et al.
2011/0155658 A1 6/2011 Graber et al.
2011/0180469 A1 7/2011 Sato et al.
2011/0192774 A1 8/2011 Ogose
2011/0192786 A1 8/2011 Nagai et al.
2012/0240901 A1 9/2012 Yamada et al.
2013/0233285 A1* 9/2013 Yamada ..... F02M 25/00 123/514
2014/0096849 A1 4/2014 Akagi et al.
2014/0345719 A1* 11/2014 Kim ..... F02M 37/14 137/544
2015/0060349 A1 3/2015 Ishitoya et al.
2016/0108872 A1* 4/2016 Akagi ..... F02M 37/103 210/416.4
2018/0209386 A1 7/2018 Hayashi
2019/0063383 A1* 2/2019 Kim ..... F02M 37/14

* cited by examiner

STRAINER AND FUEL PUMP MODULE HAVING THE SAME

CROSS-REFERENCE TO RELATED APPLICATIONS

This application is a divisional application of U.S. Ser. No. 14/283,553, filed on May 21, 2014, which claims priority under 35 U.S.C. § 119 to Korean Patent Application No. 10-2013-0058095, filed on May 23, 2013, in the Korean Intellectual Property Office, the disclosure of which is incorporated herein by reference in its entirety.

TECHNICAL FIELD

The present invention relates to a strainer and a fuel pump module having the same, and more particularly, to a strainer capable of preventing a filter paper from stopping since the filter paper contacts each other at a portion at which the strainer is folded, in the strainer connected to an inlet of a fuel pump or a fuel pump module to filter fuel sucked thereinto, and a fuel pump module having the same.

BACKGROUND

An apparatus such as a vehicle which is driven by being supplied with liquid fuel such as a gasoline engine and a diesel engine is provided with a fuel tank and the fuel tank is provided with a fuel pump module, in which the fuel pump module is configured to be connected to the engine via a fuel supply line to supply fuel stored inside the fuel tank to the engine. In this case, a fuel inlet of the fuel pump module is provided with a strainer which primarily filters the fuel inside the fuel tank to be sucked into a fuel pump which is disposed inside the fuel pump module.

As illustrated in FIGS. 1 and 2, a strainer 4 is disposed at a fuel inlet 3*a* of a fuel pump 3 which is disposed inside a fuel tank 1 and in the strainer 4, to prevent a phenomenon that the filtering is not made since the filter paper 4*b* contacts each other at the time of the suction of fuel, a rib 4*c* which is provided with a plurality of protruding parts is inserted into or combined with the filter paper 4*b*.

However, the strainer is formed to be folded as occasion demands, and an upper filter paper and a lower filter paper contacts each other at the folded portion and thus the fuel may not be filtered or the filtered foreign materials are deposited at the folded portion of the filter paper and thus the filter paper may stop. Further, to design the strainer so that the strainer is folded at a desired portion, the rib needs to be added with the plurality of protrusions and thus the design of the strainer may be complicated.

As the related art, there is Korean Utility Model Laid-Open Publication No. 20-1989-010861 entitled "in tank type fuel pump".

RELATED ART DOCUMENT

Patent Document (Patent Document 1) KR 20-1989-010861 U (Jul. 11, 1989)

SUMMARY

An exemplary embodiment of the present invention is directed to providing a strainer capable of preventing an upper filter paper and a lower filter paper from contacting each other at a folded portion of the strainer to prevent a deposition of filtered materials and a stoppage of the filter paper at the folded portion and a fuel pump module having the same.

In one general aspect, there is provided a strainer including: a filter paper 100 filtering fuel and having a space 130 disposed therein; an upper rib 210 combined with an outer upper portion of the filter paper 100; a plurality of protruding parts 300 protruding down from the upper rib 210 to be disposed inside the filter paper 100; and a communicating pipe 400 combined with the filter paper 100 to communicate with the space 130 of the filter paper 100, wherein the filter paper 100 and the upper rib 210 are partially folded up longitudinally, and the upper and lower portions of the filter paper 100 are formed not to contact each other at the folded portion.

The strainer may further include: a lower rib 220 combined with the outer lower portion of the filter paper 100; and the plurality of protruding parts 300 protruding up from the lower rib 220 to be disposed inside the filter paper 100; wherein the filter paper 100, the upper rib 210, and the lower rib 220 are partially folded longitudinally and thus the upper and lower portions of the filter paper 100 are formed not to contact each other at the folded portion.

The upper rib 210 and the lower rib 220 may be disposed in parallel to be spaced apart from each other in the width direction of the filter paper 100 and the upper rib 210 and the lower rib 220 may be alternately disposed.

Widths W of the protruding parts may be each formed differently and distances D between the protruding parts may be each formed differently, and the width W of the protruding part and the distance D between the protruding parts may be more narrowly formed at the portion at which the filter paper is folded than at the portion at which the filter paper is not folded.

In another general aspect, there is provided a strainer 1000 including: a filter paper 100 filtering fuel and having a space 130 disposed therein; an inner rib 230 disposed inside the filter paper 100; a plurality of protruding parts 300 protruding up and down from the inner rib 230 to be disposed inside the filter paper 100; and a communicating pipe 400 combined with the filter paper 100 to communicate with the space 130 of the filter paper 100, wherein the filter paper 100 and the inner rib 230 are partially folded up longitudinally, and the upper and lower portions of the filter paper 100 are formed not to contact each other at the folded portion.

Widths W of the protruding parts may be each formed differently and distances D between the protruding parts may be each formed differently, and the width W of the protruding part and the distance D between the protruding parts may be more narrowly formed at the portion at which the filter paper is folded than at the portion at which the filter paper is not folded.

In still another general aspect, there is provided a fuel pump module 2000 including: the strainer 1000 as described above, wherein the strainer 1000 is disposed inside a reservoir body 1200 in a partially folded state and a communicating pipe 400 of the strainer 1000 is connected to an inlet 1110 of the fuel pump 1100 which is disposed inside the reservoir body 1200.

DETAILED DESCRIPTION OF EMBODIMENTS

Hereinafter, a strainer and a fuel pump module having the same according to exemplary embodiments of the present invention will be described in detail with reference to the accompanying drawings.

Figure 1:
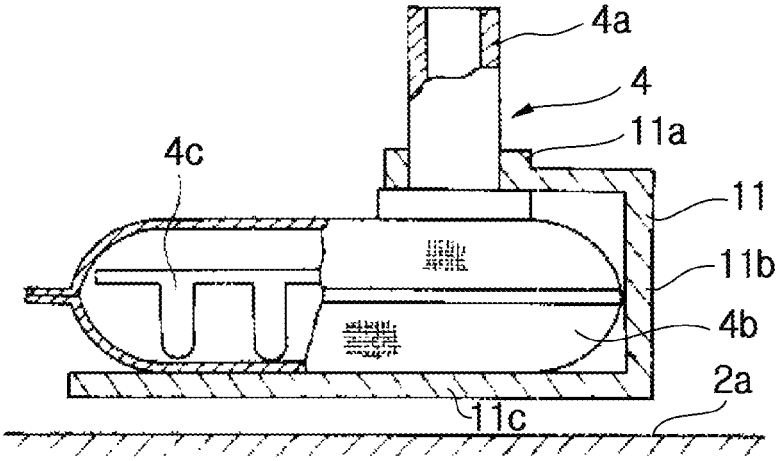
FIG. 1 Prior Art
FIGS. 1 and 2 are cross-sectional views illustrating a strainer and a fuel pump module according to the related art.
Figure 2:
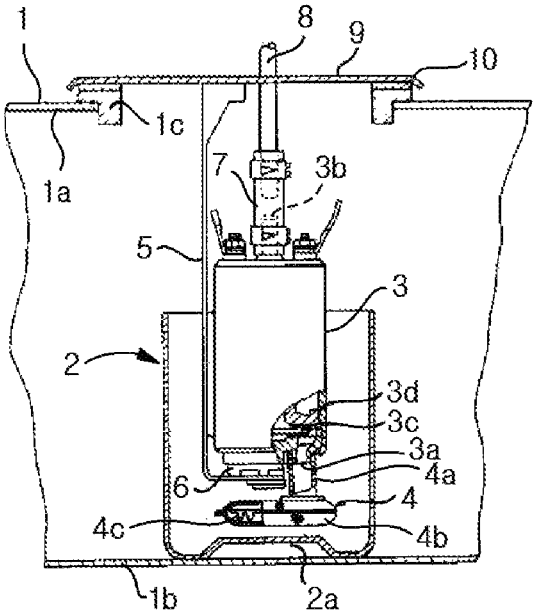
FIG. 2 Prior Art
Figure 3:
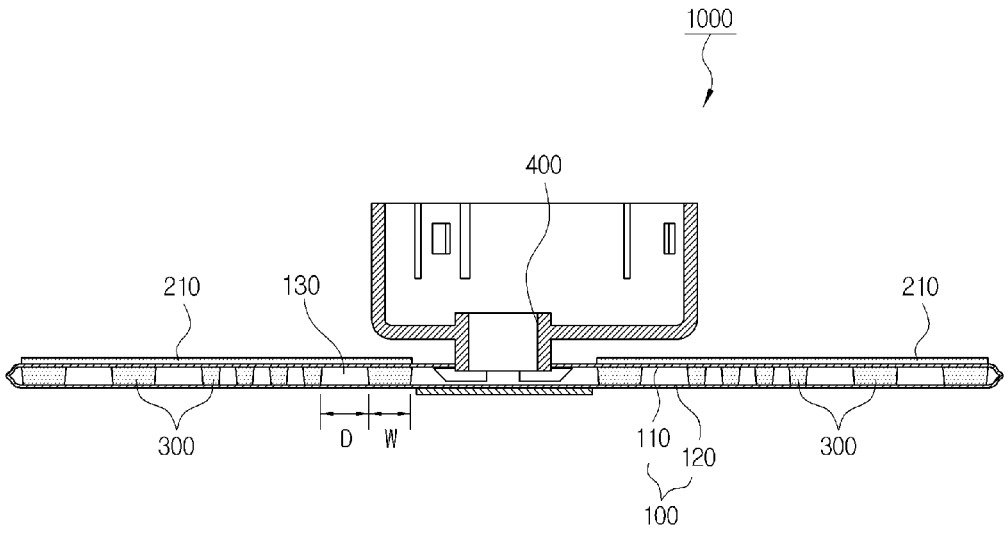
FIG. 3 is a cross-sectional view illustrating a strainer according to a first exemplary embodiment of the present invention.
Figure 4:
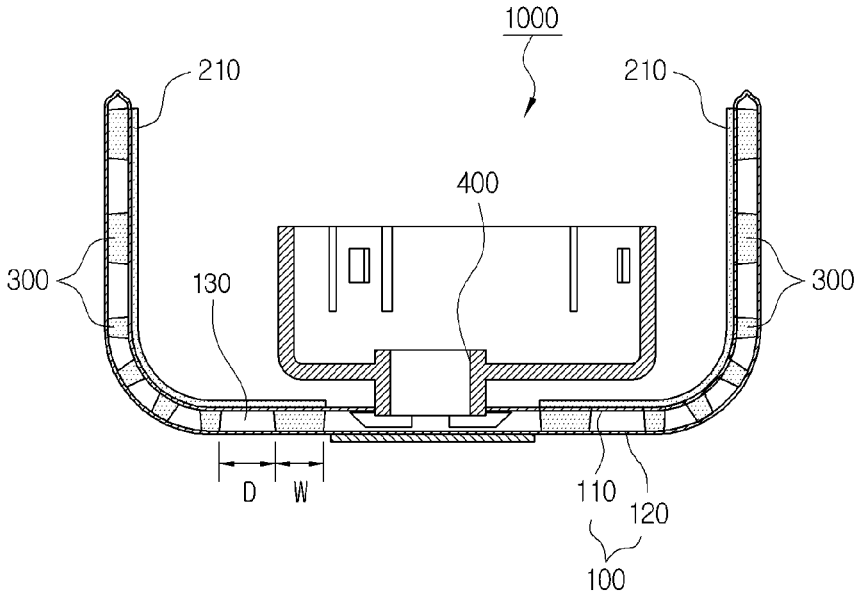
FIGS. 4 and 5 are a cross-sectional view and a perspective view illustrating a state in which the strainer of FIG. 3 is folded.
Figure 5:
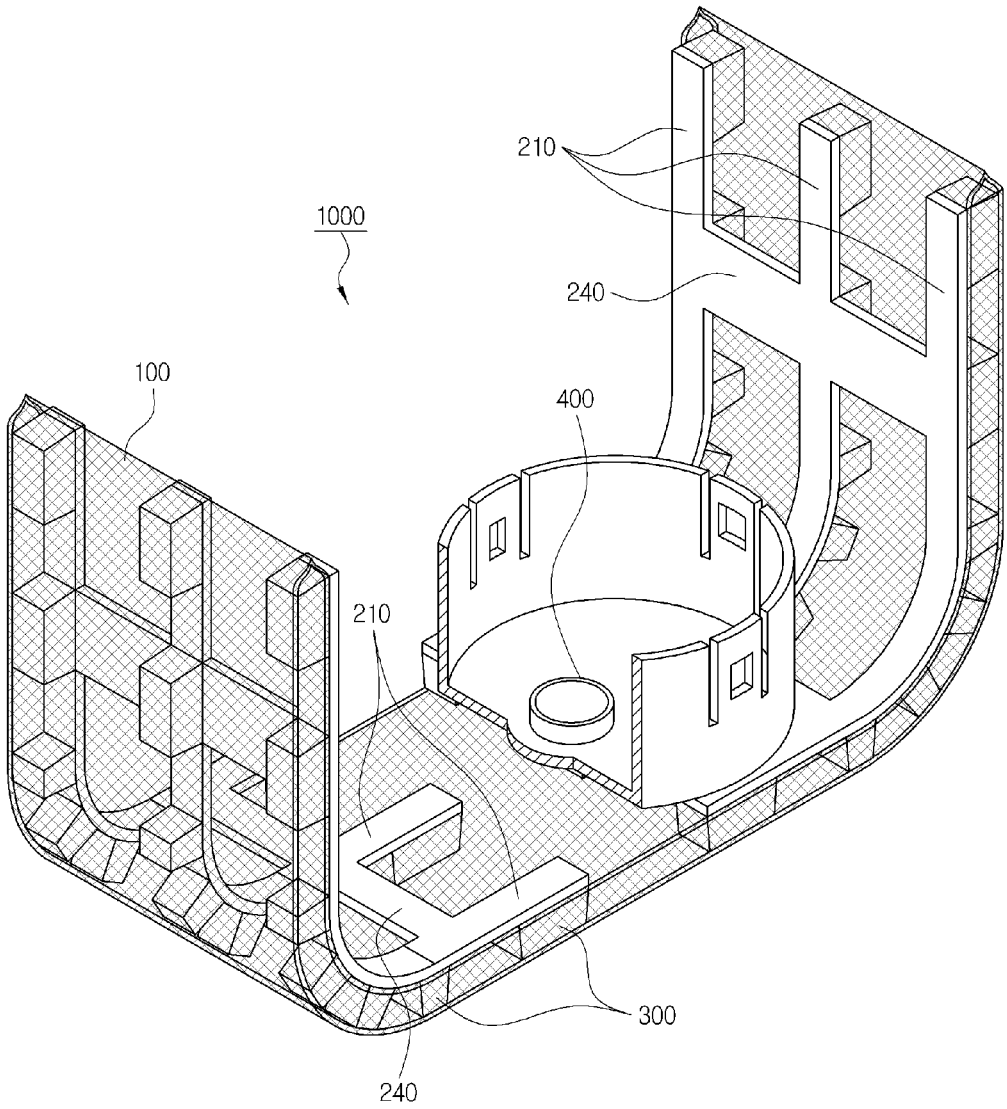

First, as illustrated in FIGS. 3 to 5, a strainer 1000 according to a first exemplary embodiment of the present invention includes a filter paper 100 filtering fuel. The filter paper 100 is formed of an upper filter paper 110 and a lower filter paper 120 and having a space 130 defined between the upper and lower filter paper 120. An upper rib 210 is disposed on the upper surface portion of the upper filter paper. A plurality of protruding parts 300 protrudes down from the upper rib 210 to be disposed inside the space 130 so as to maintain the space 130. A communicating pipe 400 is installed in the upper filter paper 110 to communicate with the space 130 of the filter paper 100. As shown in FIG. 5, the filter paper 100 and the upper rib 210 are partially folded. However, an upper filter paper 110 and the lower filter paper 120 are not contacted with each other by means of the protruding part 300 of the upper rib 210, even at the folded portion of the strainer 1000.

The filter paper 100 filters fuel and may be formed in a thin mesh form. Further, as described above, the filter paper 100 is formed of the upper filter paper 110 and the lower filter paper 120 spaced apart from each other so as to have the space 130 in-between. Edges of the upper filter paper 110 and the lower filter paper 120 are coupled with each other along the edges by a welding method, and the like.

The upper rib 210 is installed in an upper surface of the upper filter paper 110, which is the outer upper portion of the filter paper 100. In this configuration, the upper rib 210 is formed in a long bar shape and thus may adhere to the upper surface of the upper filter paper 110. Meanwhile, the upper rib 210 is formed in plural, in which the plurality of upper ribs 210 may be formed in parallel to be spaced apart from each other in a width direction of the strainer 1000. Further, when the upper rib 210 is formed in plural, a connection rib 240 which connects between the neighboring upper ribs 210 may also be formed. Therefore, as illustrated in FIGS. 3 to 5, the upper rib 210 supports the outer upper portion of the filter paper 100 and thus serves to maintain the form of the filter paper 100.

The protruding part 300 protrudes down from the upper rib 210 and is disposed inside the space 130. In this case, the protruding part 300 is formed in plural, in which the plurality of protruding parts 300 are formed along the upper rib 210, being spaced apart from each other. Further, a lower end of the protruding part 300 is extended to the upper surface of the lower filter paper 120 to maintain a distance between the upper filter paper 110 and the lower filter paper 120, i.e., maintain the space 130.

In this case, the upper filter paper 110, the upper rib 210, and the protruding part 300 are made of a plastic resin material. The upper rib 210 and the protruding part 300 are injection molded together, having the upper filter paper 110 disposed therebetween, such that the upper rib 210, the protruding parts 300 and the upper filter paper 110 are formed in an integral form where the upper rib 210 and the protruding part 300 down from the upper rib 210 penetrate through the upper filter paper 110. Therefore, the upper filter paper 110, the upper rib 210, and the protruding part 300 are integrally formed and then the edges of the upper filter paper 110 and the lower filter paper 120 are bonded to each other.

The communicating pipe 400 is disposed in the filter paper 100 so as to fluid-communicate with the space 130. More specifically, the communicating pipe 400 may be connected with the space 130 through the upper filter paper 110. Further, the communicating pipe 400 is also made of a plastic resin material and may be bonded to the upper filter paper 110 by the welding method, and the like to penetrate through the upper filter paper 110. In this case, the lower end of the communicating pipe 400 disposed inside the space 130 of the filter paper 100 is provided with a plurality of plates which radially protrude, are spaced apart from each other along a circumferential direction, and protrude down from the lower end of the communicating pipe 400 and thus the lower end of the communicating pipe 400 does not contact the lower filter paper 120, thereby smoothing the filtering and injection of fuel.

Therefore, the strainer 1000 according to the exemplary embodiment of the present invention is configured to suck the fuel into the space 130 inside the filter paper 100. During the suction of the fuel, the fuel is filtered through the upper filter paper 110 and the lower filter paper 120 and then the filtered fuel flows along the communicating pipe 400.

In this case, the filter paper 100 and the upper rib 210 are partially folded longitudinally, but the upper and lower filter papers 110 of the filter paper 100 are not to contact each other at the folded portion. That is, as illustrated in FIG. 4, in the state in which the filter paper 100 and the upper rib 210 are partially folded up, the protruding parts 300 support the upper filter paper 110 and the lower filter paper 120 of the folded and rounded portion to maintain the distance between the upper filter paper 110 and the lower filter paper 120.

As described above, the strainer according to the exemplary embodiment of the present invention is formed not to contact the upper and lower filter papers at the folded portion even though the strainer is folded. Therefore, it is possible to prevent the deposition of filtered materials and the stoppage of the filter paper at the folded portion. Further, the upper rib 210 is disposed on the upper surface of the upper filter paper 110 which is the outside of the filter paper 100 and thus the protruding parts 300 protrude down from the upper rib 210, such that the upper rib 210 and the filter paper 100 may be easily folded regardless of the distance between the protruding parts 300. The upper rib 210 is fixed with the upper filter paper 110, such that it is possible to prevent the upper filter paper 110 from being folded inwardly (toward the space of the filter paper 100) at the time of the folding, thereby preventing the upper filter paper 110 and the lower filter paper 120 from contacting each other. Further, the upper rib 210 is provided outside the filter paper 100 and therefore a volume of the space 130 inside the filter paper 100 may be increased, thereby reducing a flowing resistance during the filtering of fuel.

Figure 6:
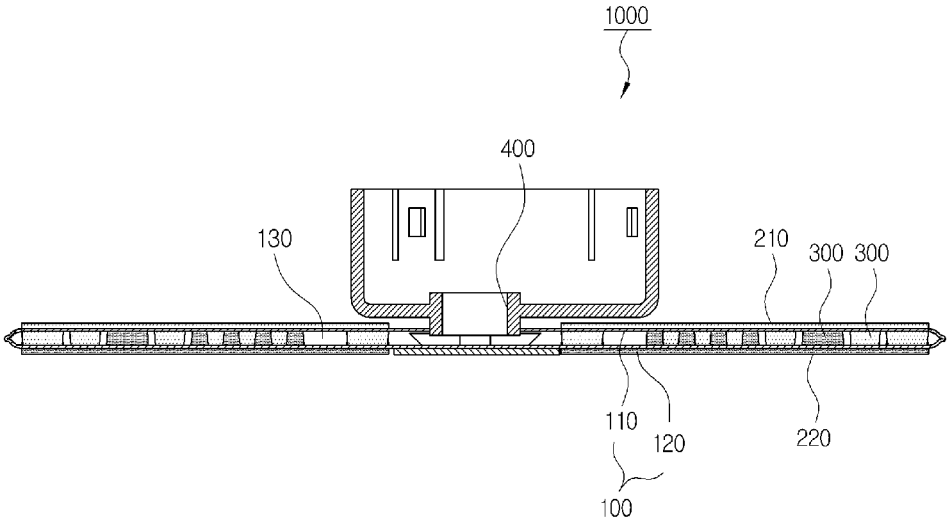
FIG. 6 is a cross-sectional view illustrating a strainer according to a second exemplary embodiment of the present invention.
Figure 7:
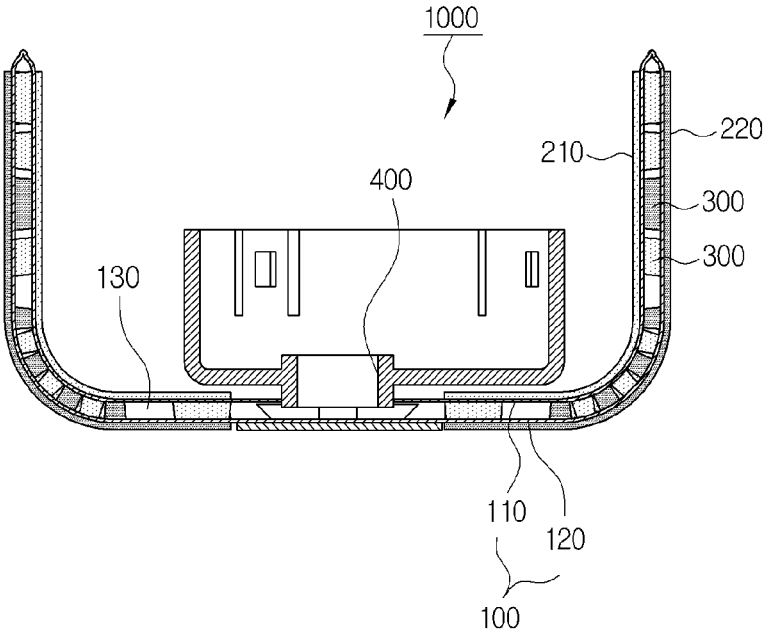
FIGS. 7 and 8 are a cross-sectional view and a perspective view illustrating a state in which the strainer of FIG. 6 is folded.
Figure 8:
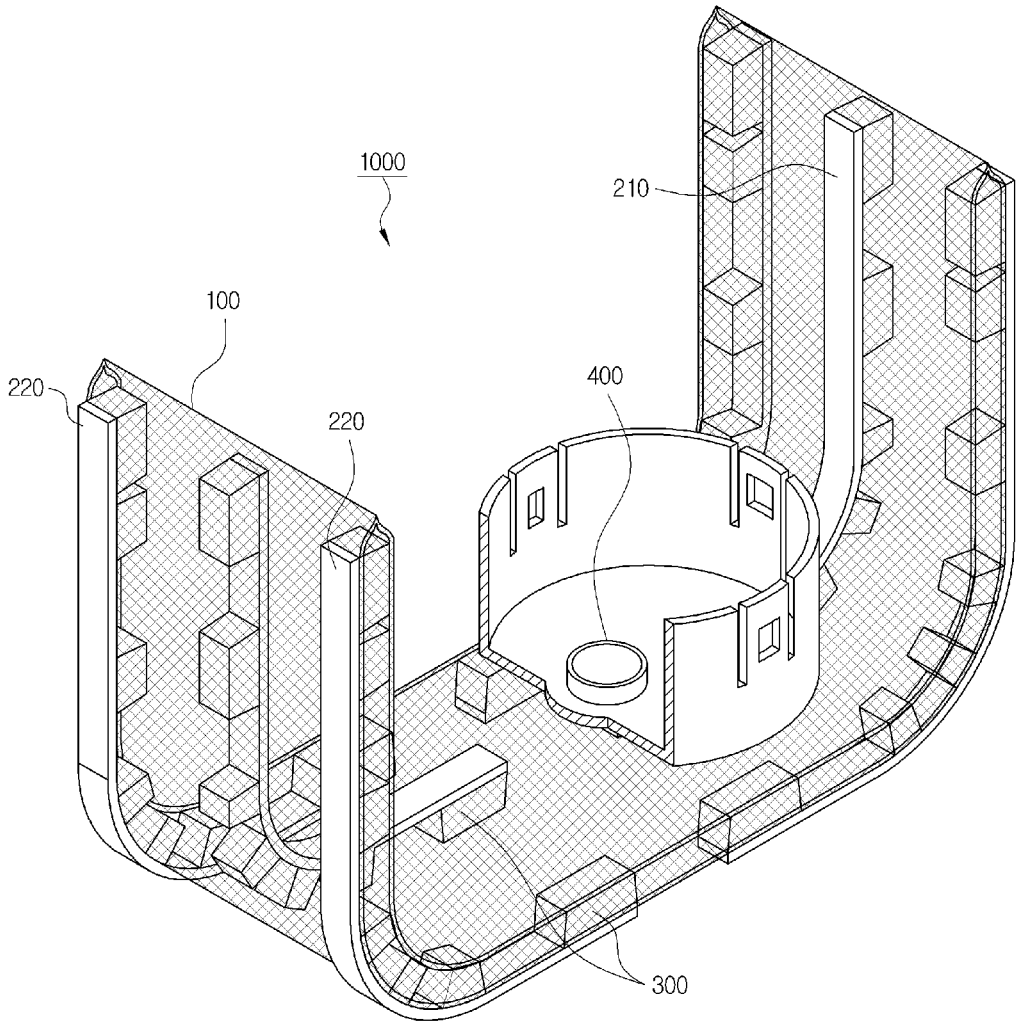

Further, FIGS. 6 to 8 shows a second exemplary embodiment of the present invention. The strainer 1000 according to the second exemplary embodiment of the present invention further includes: a lower rib 220 coupled to the outer bottom portion of the filter paper 100; and the plurality of protruding parts 300 protruding up from the lower rib 220 to be disposed inside the space 130 of the filter paper 100. Similar to the first embodiment, in the second embodiment, the filter paper 100, the upper rib 210, and the lower rib 220 may be partially folded longitudinally and the upper and lower filter papers of the filter paper 100 may be not to contact each other at the folded portion by means of the protruding parts 300 of both the upper rib 210 and the lower rib 220.

As illustrated in FIGS. 6 to 8, in the strainer according to the second exemplary embodiment of the present invention, the lower rib 220 is additionally provided at the lower surface of the lower filter paper 120 and the protruding part 300 protrudes up from the lower rib 220 to be disposed in the space 130 inside of the filter paper 100.

Therefore, even though the strainer is folded, the form of the filter paper 100 is easily maintained by the upper rib 210 and the lower rib 220 which are each provided with the plurality of protruding parts 300 and thus the upper and lower filter papers are not to contact each other at the portion folded by the protruding parts. Therefore, it is possible to prevent the deposition of the filtered materials and the stoppage of the space 130 of the filter paper 100 at the folded portion.

In this case, the upper rib 210 and the lower rib 220 may be in parallel to be spaced apart from each other in the width direction of the filter paper 100 and the upper rib 210 and the lower rib 220 may be alternately disposed, as illustrated in FIG. 8. That is, the upper rib 210 is disposed at a center in the width direction of the upper filter paper 110 and the lower rib 220 is disposed at both sides in the width direction of the lower filter paper 120, such that the upper rib 210 and the lower rib 220 may be formed to be alternately disposed in parallel so as to be spaced apart from each other in the width direction of the filter paper 100.

Therefore, the distance between the upper and lower filter papers at the portion at which the strainer is folded is easily maintained, such that it is possible to prevent the deposition of the filtered materials and the stoppage of the space inside the filter paper at the folded portion.

Further, widths W of the protruding parts 300 may be different from each other and distances D between the protruding parts may be different from each other. Further, the width W of the protruding part 300 and the distance D between the protruding parts 300 may be relatively narrow at the portion at which the filter paper 100 is folded, as shown in FIGS. 7 and 8.

That is, in connection with the plurality of protruding parts 300 protruding down from the upper rib 210, the width W of the protruding part and the distance D between the protruding parts are formed to be narrower at the folded portion than any other portion. Therefore, when the strainer is folded, the lower filter paper 120 is supported by the protruding parts 300 to easily maintain the distance between the upper and lower filter papers. Similarly, in connection with the protruding parts 300 protruding up from the lower rib 220, the width W of the protruding part and the distance D between the protruding parts are formed to be narrower at the portion at which the strainer is folded than any other portion and, thus, when the strainer is folded, the protruding parts 300 are easily support the upper filtering paper 120.

Figure 9:
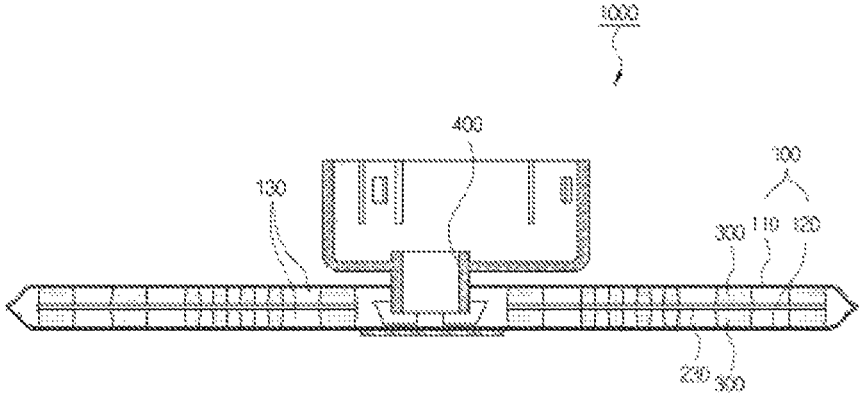
FIG. 9 is a cross-sectional view illustrating a strainer according to a third exemplary embodiment of the present invention.
Figure 10:
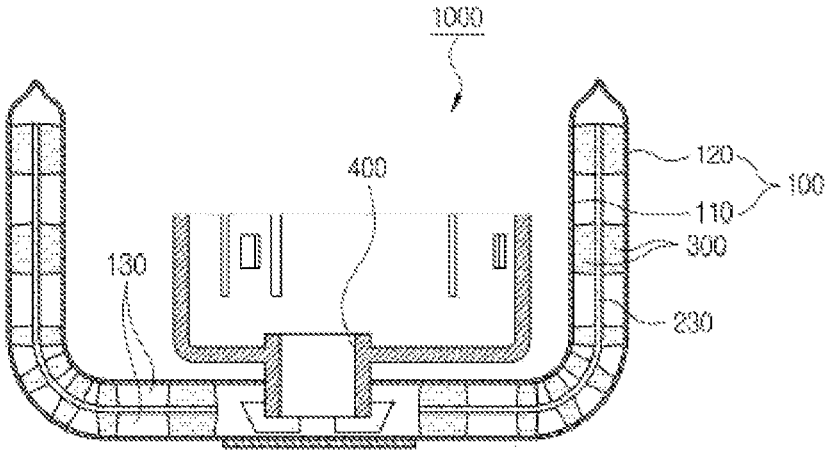
FIG. 10 is a cross-sectional view and a perspective view illustrating a state in which the strainer of FIG. 9 is folded.
Figure 11:
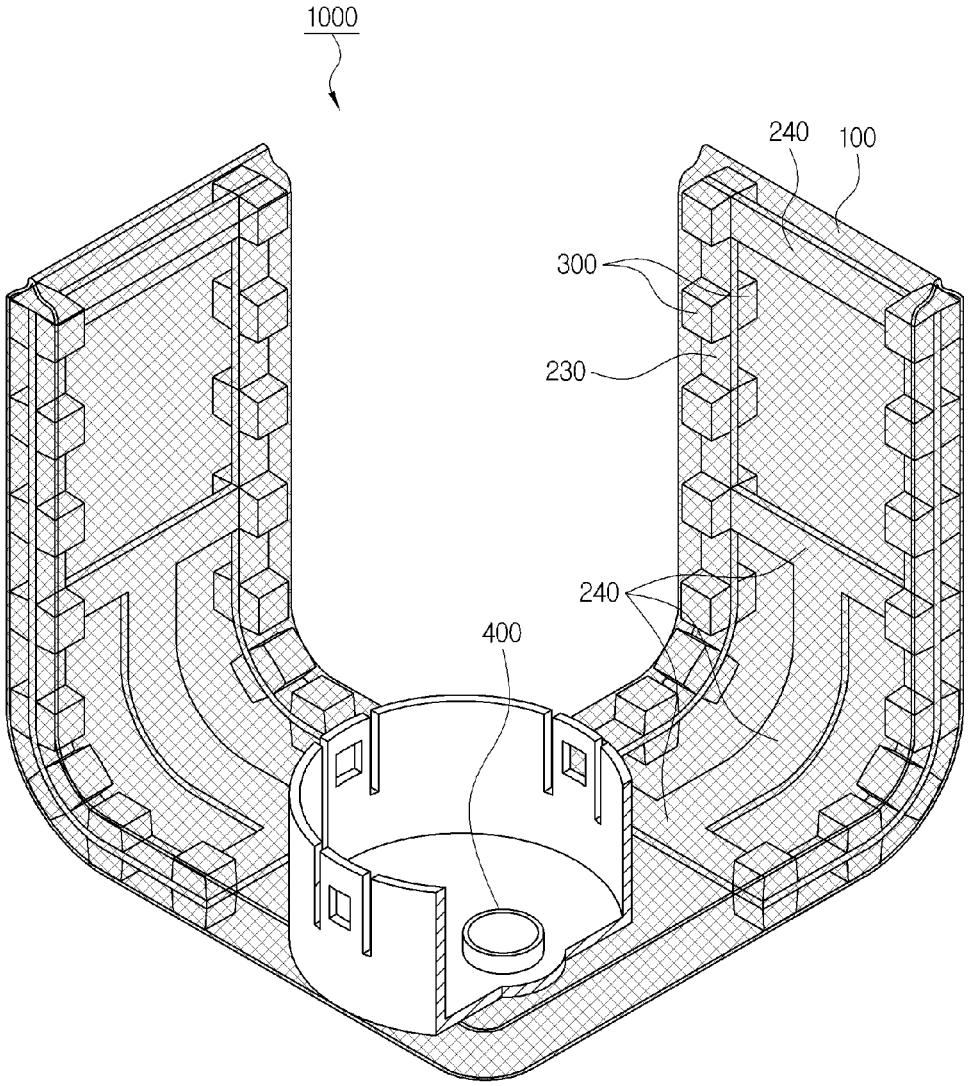
FIG. 11 is a perspective view illustrating an example in which the strainer according to the third exemplary embodiment of the present invention is modified.

Further, FIGS. 9 to 11 illustrate a third embodiment of the present invention. The strainer 1000 according to the third exemplary embodiment of the present invention includes: the filter paper 100 filtering fuel and having the space 130 formed disposed therein; an inner rib 230 disposed inside the space of the filter paper 100; a plurality of protruding parts 300 protruding up and down from the inner rib 230 to be disposed inside the space 130 of the filter paper 100; and the communicating pipe 400 mounted in the filter paper 100 to fluid-communicate with the space 130 of the filter paper 100. The filter paper 100 and the inner rib 230 are partially folded longitudinally and the upper and lower portions of the filter paper 100 are formed not to contact each other at the folded portion by filter paper 110 the protruding parts 300.

Similar to the first and second embodiment, the filter paper 100 is formed of an upper filter paper 110 and a lower filter paper 120, edges of which are bonded or welded to each other to define the space 130 of the filter paper 100.

As illustrated in FIGS. 9 to 11, the inner rib 230 is disposed inside the space 130 of the filter paper 100, and the upper and lower portions of the inner rib 230 are provided with the plurality of protruding parts 300 in such a manner that the upper filter paper 110 and the lower filter paper 120 are not contacted to each other at the portion where the strainer is folded. In this case, in the state in which the upper and lower portions of the inner rib 230 are integrally provided with the protruding parts 300, the inner rib 230 is inserted into the space 130 of the filter paper 100 and then the edge portions of the upper filter paper 110 and the lower filter paper 120 may be sealed by the welding method, and the like.

Therefore, in the strainer according to the third exemplary embodiment of the present invention, the protruding parts 300 formed on the upper and lower portions of the inner rib 230 support the upper filter paper 110 and the lower filter paper 120, such that the upper filter paper 110 and the lower filter paper 120 may not contact each other to maintain the distance in-between.

Further, as illustrated in FIG. 11, in the strainer according to the third exemplary embodiment of the present invention, the filter paper 100 is formed in an asymmetrical form and thus may also be formed to be partially folded up.

Further, similarly to the first and second embodiments, in the strainer according to the third exemplary embodiment of the present invention, the widths W of the protruding parts may be different from each other and the distances D between the protruding parts may be different from each other. Further, the width W of the protruding part and the distance D between the protruding parts may be relatively narrow at the portion at which the filter paper 100 is folded.

Figure 12:
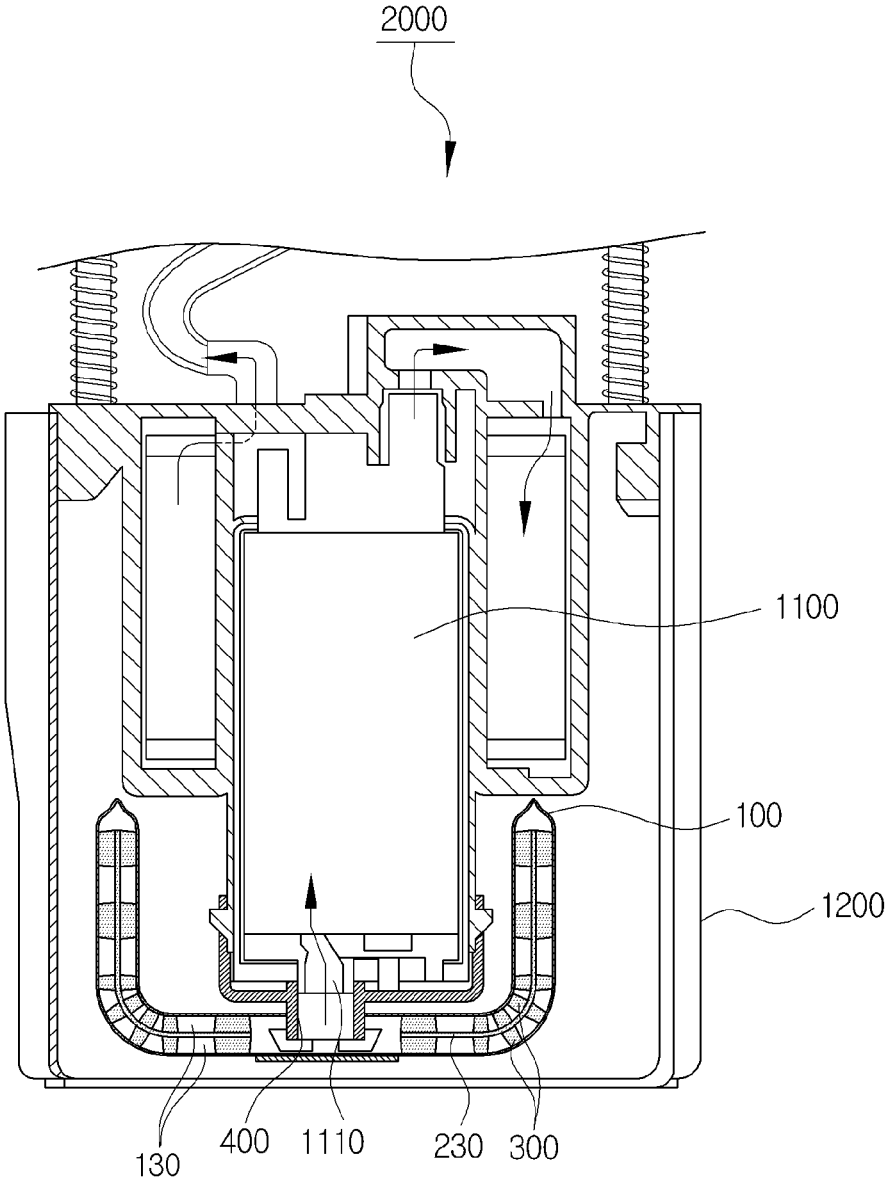
FIG. 12 is a schematic cross-sectional view illustrating a fuel pump module having the strainer according to the exemplary embodiment of the present invention.

Further, FIG. 12 illustrates a fuel pump module 2000 according to an exemplary embodiment of the present invention. The fuel pump module 2000 is configured to include the strainer 1000, in which the strainer 1000 is disposed inside a reservoir body 1200 in the partially folded state and the communicating pipe 400 of the strainer 1000 is configured to be connected to an inlet 1110 of the fuel pump 1100 which is disposed inside the reservoir body 1200.

That is, as illustrated in FIG. 12, the fuel pump module 2000 according to the exemplary embodiment of the present invention is disposed inside the fuel tank and thus the fuel inside the fuel tank is partially filled inside the reservoir body 1200, and the communicating pipe 400 of the strainer 1000 is connected to the inlet 1110 of the fuel pump 1100 so that the fuel in the reservoir body 1200 may be sucked into the fuel pump 1100 through the strainer 1000. Therefore, the fuel pump module 2000 may be configured so that the filtered fuel is sucked into the fuel pump 1100 through the lower portion of the strainer 1000 and both sides of the strainer 1000 which is vertically folded.

As described above, the fuel pump module 2000 according to the exemplary embodiment of the present invention is configured so that the upper and lower filter papers are formed not to contact each other at the portion at which the strainer is folded, and thus it is possible to prevent the deposition of the filtered materials and the stoppage of the filter paper at the folded portion.

According to the strainer and the fuel pump module having the same in accordance with the present invention, even though the strainer is folded, the upper and lower filter papers are formed not to contact each other at the folded portion, thereby preventing the deposition of the filtered materials and the stoppage of the filter paper at the folded portion.

The present invention is not limited to the above-mentioned exemplary embodiments but may be variously applied, and may be variously modified by those skilled in the art to which the present invention pertains without departing from the gist of the present invention claimed in the claims.

What is claimed are:

1. A strainer, comprising:

a filter paper filtering fuel, the filter paper including an upper filter paper and a lower filter paper, edges of which are connected to each other to form a space between the upper filter paper and the lower filter paper;

an inner rib disposed in the space;

a plurality of protruding parts protruding up and down from the inner rib and disposed in the space; and a communicating pipe disposed on the filter paper to fluid-communicate with the space of the filter paper in such a way that the fuel inside the space flows through the communicating pipe to outside the strainer, wherein the filter paper and the inner rib are partially bent, a bent portion is formed in a rounded form, widths W of the protruding parts vary and distances D between the protruding parts vary, and the width W of the protruding part and the distance D between the protruding parts are more narrowly formed at the portion at which the filter paper is bent than at the portion at which the filter paper is not bent, and the upper filter paper and the lower filter paper are spaced apart from each other by the protruding parts protruding up and down from the inner rib.

2. A fuel pump module, comprising:

the strainer of claim 1, wherein the strainer is disposed inside a reservoir body and a communicating pipe of the strainer is connected to an inlet of the fuel pump which is disposed inside the reservoir body.

* * * * *